United States Patent [19]

Brayman et al.

[11] Patent Number: 4,942,064

[45] Date of Patent: Jul. 17, 1990

[54] METHOD FOR FIXING CHROMATED COPPER ARSENATE TREATING AGENTS IN WOOD

[75] Inventors: Theron R. Brayman, Wadsworth, Ohio; Eugene A. Pasek, Monroeville; Gregory D. Wall, Apollo, both of Pa.

[73] Assignee: Hickson Corporation, Conley, Ga.

[21] Appl. No.: 209,512

[22] Filed: Jun. 21, 1988

[51] Int. Cl.[5] ..... B05D 3/00; B05D 3/10

[52] U.S. Cl. ..... 427/297; 427/343; 427/440

[58] Field of Search ..... 427/297, 301, 440, 343

[56] References Cited

U.S. PATENT DOCUMENTS

| | | | |
|---|---|---|---|
| 3,894,569 | 7/1975 | Huttunen | 427/440 |
| 3,945,835 | 3/1976 | Clarke et al. | 427/440 |
| 4,194,033 | 3/1980 | Motgi | 427/440 |
| 4,622,248 | 11/1986 | Leach | 427/440 |

FOREIGN PATENT DOCUMENTS

| | | | |
|---|---|---|---|
| 0034905 | 3/1980 | Japan | 427/440 |
| 82/03817 | 11/1982 | World Int. Prop. O. | 427/440 |

*Primary Examiner*—Janyce Bell

*Attorney, Agent, or Firm*—Herbert J. Zeh, Jr.

[57] ABSTRACT

A method for fixing chromated copper arsenate agents in wood by treating the wood with a fixing agent selected from the following:

(a)

$NH_2O—R_2$; (b)

$R_2—NHOH$; and (c)

$R_3—COOH$ (d)

wherein $R_1$ is the same or different and is hydrogen, phenyl or an alkyl group having 1 to 4 carbon atoms, $R_2$ is hydrogen or an alkyl group having 1 to 4 carbon atoms and $R_3$ is $(R_4)_2(HO)C—$ or $R_4OOC—$ and $R_4$ is hydrogen, an alkyl group having 1 to 4 carbon atoms, phenyl or pyridyl.

12 Claims, 4 Drawing Sheets

CCA FIXATION VERSUS TEMPERATURE
TREATING CYCLE: FULL CELL

CCA FIXATION VERSUS TEMPERATURE TREATING CYCLE: MODIFIED FULL CELL

HYDRAZINE PENETRATION VS HYDRAZINE CONCENTRATION AND TIME AT PRESSURE

25 C/SYP/Dual MFC/2.0%CCA

N2H4 RETENTION/PENETRATION VS PRESSURE
PLANT TRIAL: 2% CCA/1% N2H4 / DUAL / MFC

METHOD FOR FIXING CHROMATED COPPER ARSENATE TREATING AGENTS IN WOOD

BACKGROUND OF THE INVENTION

1. Field of the Invention

The present invention relates to the preservation of wood and, in particular, the preservation of wood by means of chromated copper arsenate solutions.

2. Brief Description of the Prior Art

The preservation of wood under pressure with various chromated copper arsenate (CCA) solutions is well known in the art. Such solutions are described, for example, in the American Wood Preservers' Association *Book of Standards* (1987), Section P5-86, pages 2 and 3.

Fixation is a process whereby CCA solutions undergo reaction with wood to be relatively insoluble. The process involves the reaction of hexavalent chromium with wood to give trivalent chromium and a corresponding reduction in acidity, thereby producing insoluble CCA-wood compounds. The reaction of hexavalent chromium with wood is slow at ambient temperatures, typically requiring several days for completion. The reaction can be accelerated by heat. In order to enhance fixation of CCA-wood commercially, a variety of heating techniques have been developed which include kiln drying, steam treatment, and microwave treatment. A disadvantage, however, of such techniques is that they require considerable capital investment and are time consuming. It is, therefore, the object of the present invention to provide a means for fixing aqueous CCA chemicals in wood both quickly and inexpensively.

SUMMARY OF THE INVENTION

A chemical treatment method has been discovered that rapidly fixes the CCA chemicals in wood. The method consists of treating the CCA impregnated wood with a second solution containing a suitable reducing agent in the treating cylinder, thus reducing capital expenditures. Suitable reducing agents for use in the method of the present invention include those having the following formulae:

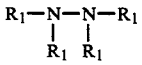

a.

$NH_2O—R_2$ b.

$R_2—NHOH$ c.

$R_3—COOH$ d.

and salts thereof, wherein $R_1$ is the same or different and is hydrogen, phenyl or an alkyl group having 1 to 4 carbon atoms; $R_2$ is hydrogen or an alkyl group having 1 to 4 carbon atoms and $R_3$ is $(R_4)_2(HO)C—$ or $R_4OOC—$ wherein $R_4$ is hydrogen, an alkyl group having 1 to 4 carbon atoms.

Hydrazine is an example of the compounds having the first formula above. It is a commonly used reducing agent and anti-corrosion material. As a reducing agent, it is capable as follows of reaction on both acid and alkaline solutions:

$$N_2H_5^+ \rightarrow N_2 + 5H^+ + 4e'$$

and $$N_2H_4 + 4OH^- \rightarrow N_2 + 4H_2O + 4e'$$

giving nitrogen as a by-product. The reaction of hydrazine with chromium (VI) is:

$$3N_2H_5^+ + 4CrO_4^{2-} + 17H^+ \rightarrow 3N_2 + 4Cr^{3+} + 16\text{-}H_2O$$

with the by-products being nitrogen and water.

Alpha-hydroxylamine and beta-hydroxylamine are, respectively, examples of the compounds having the second and third formula above. They are reducing agents and their reaction with chromium (VI) is:

$$6NH_2OH + 2CrO_4^{2-} + 10H^+ \rightarrow 3N_2 + 2Cr^{3+} + 14\text{-}H_2O$$

with the by-products of hydroxylamine being nitrogen and water.

Included in the compounds having the fourth formula, above, are a variety of materials which enhance chromium (VI) oxidation reactions. These materials are capable of forming mono- and di-esters with chromic acid. Amont these are oxalic acid, glycolic acid, picolinic acid, 2-hydroxy-2-methylbutyric acid, and mandelic acid. The mono-Cr(VI) esters are typified by five membered rings:

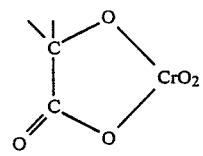

BRIEF DESCRIPTION OF THE DRAWINGS

The present invention is further explained with reference to the accompanying drawings in which.

DETAILED DESCRIPTION

Figure 1:
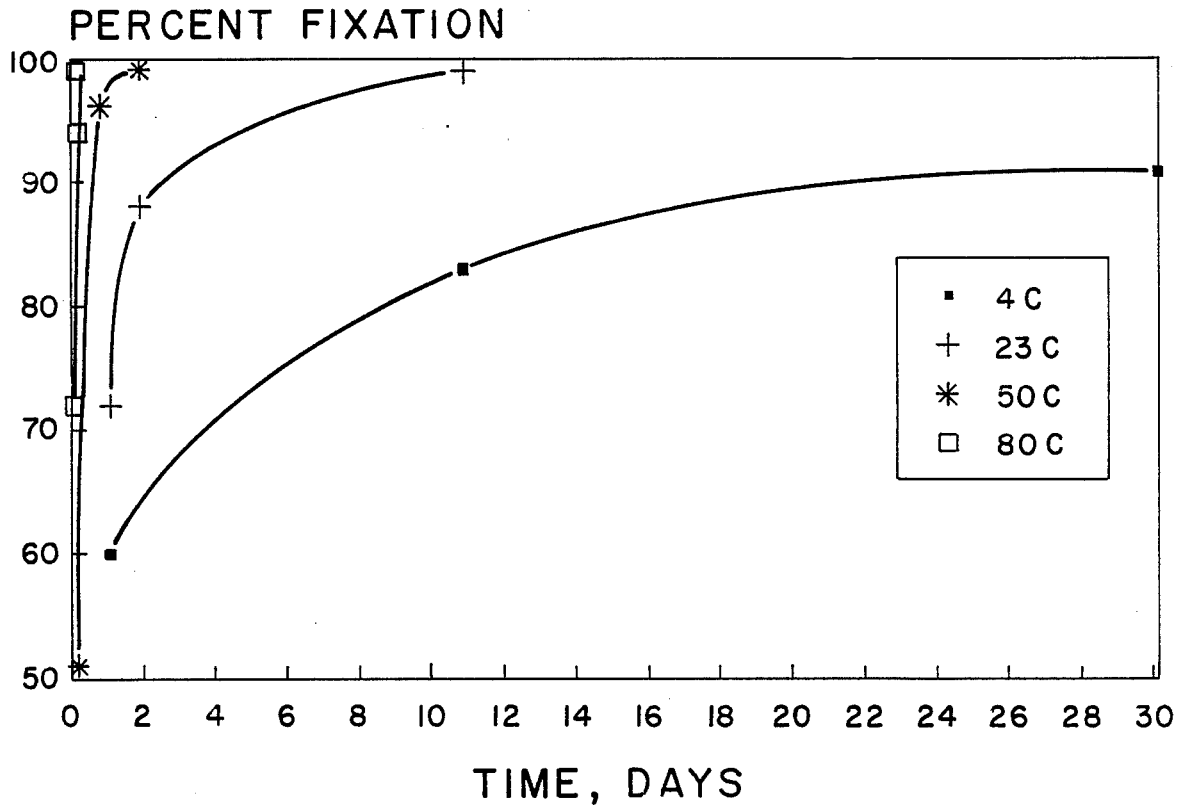
FIG. 1 is a graph of CCA fixation versus temperature for various temperatures in a full cell treating process.

While the preparation of CCA solution is well known, the preparation of one type (50% concentration, Type C) would be accomplished by first charging a stirred vessel with 39 parts water and then adding 28 parts of 75 percent $H_3As_O4$ (arsenic acid) solution. ($As_2O_5$ is present as $H_3AsO_4$). 23.75 parts $CrO_3$ flake or crystal is then added and stirred until dissolved. 9.25 parts CuO powder is then added. The CuO is stirred until it is dissolved. The reaction with CuO is exothermic and the temperature should not exceed 180° F. The resulting solution is red-brown in color and has a density of 1.82 g/cc. It would be diluted with water to 0.5–4.0 percent concentration before use.

The wood is treated in a steel pressure cylinder, typically 6 ft. to 8 ft. in diameter and 60 ft. to 120 ft. long. The wood is loaded on wheeled trams, rolled into the cylinder and the cylinder closed and sealed. An initial vacuum is drawn on the cylinder to remove air from the wood cells, then the treating solution is admitted to the cylinder and pressure applied, typically 150 p.s.i.g. After a period of time, the cylinder is drained and a final vacuum pulled on the cylinder to remove excess solution that would otherwise ooze out slowly, causing the wood to drip. The final vacuum is typically about 26 inches of mercury. Two basic variations of treating cycle are currently in use, "full cell" and "modified full cell", distinguished by how much initial vacuum is used. Full cell cycles, so called because the wood cells are filled with solution, use a "full" vacuum of about 26 to 28 inches of mercury, whatever the equipment can reach. Modified full cell cycles use a partial initial vacuum, anywhere from 7 inches to 20 inches. Although it is not extensively used on an empty cell cycle procedure in which there is no initial vacuum and sometimes even a few p.s.i.g. of initial air pressure could also be employed. The amount of air in the wood cells when the solution is introduced will largely determine how much solution is retained by the wood and, hence, how long it will take to dry after treatment.

In the method for the present invention a cycle that permits impregnation of the wood with a second solution is desired. Typically, the wood is treated by the modified full cell cycle after which the second, fixative solution is introduced to the cylinder. A second modified full cell cycle is similarly used for this second treatment with the fixative agent. The fixative solution consists of about 0.5 to 4.0 weight percent by weight reagent. Normally about 1.0 to 2.0 percent is used for adequate CCA wood fixation.

To further explain the method and composition of the present invention and demonstrate its advantages over the prior art, the following examples and comparative tests are provided.

COMPARATIVE TEST 1

This test demonstrates results for thermal fixation in a full cell treating cycle. Thirteen 1½" blocks of southern yellow pine were pressure treated with a 2.00 percent CCA oxides solution, made by diluting a 50 percent WOLMANAC® concentrate with de-ionized water. The treating cycle consisted of 10 minutes at vacuum, 24 inches of mercury, and 30 minutes at 150 p.s.i.g. pressure. The treating data are given in Table 1. Samples 1–3 were placed in a desiccator over water and maintained at 50° C. Similarly, samples 4–6, 7–9 and 10–12 were maintained at 23°, 4° and 80° C., respectively. Sample 13 was squeezed immediately after CCA treatment using a hydraulic press to yield about half the total impregnated solution. The remaining blocks were removed at various time intervals and similarly squeezed. Chromium (VI) content was measured immediately by titration with standardized iron (II) solution. The percent fixation was calculated using the equation $$\text{Percent Fixation} = \frac{\text{Cr(VI) Solution}^{(1)} - \text{Cr(VI) Extrudate}^{(2)}}{\text{Cr(VI) Solution}^{(1)}} \times 100$$

The results of these experiments are summarized in Table 2 and graphically illustrated in FIG. 1 for full cell treating cycle.

COMPARATIVE TEST 2

Figure 2:
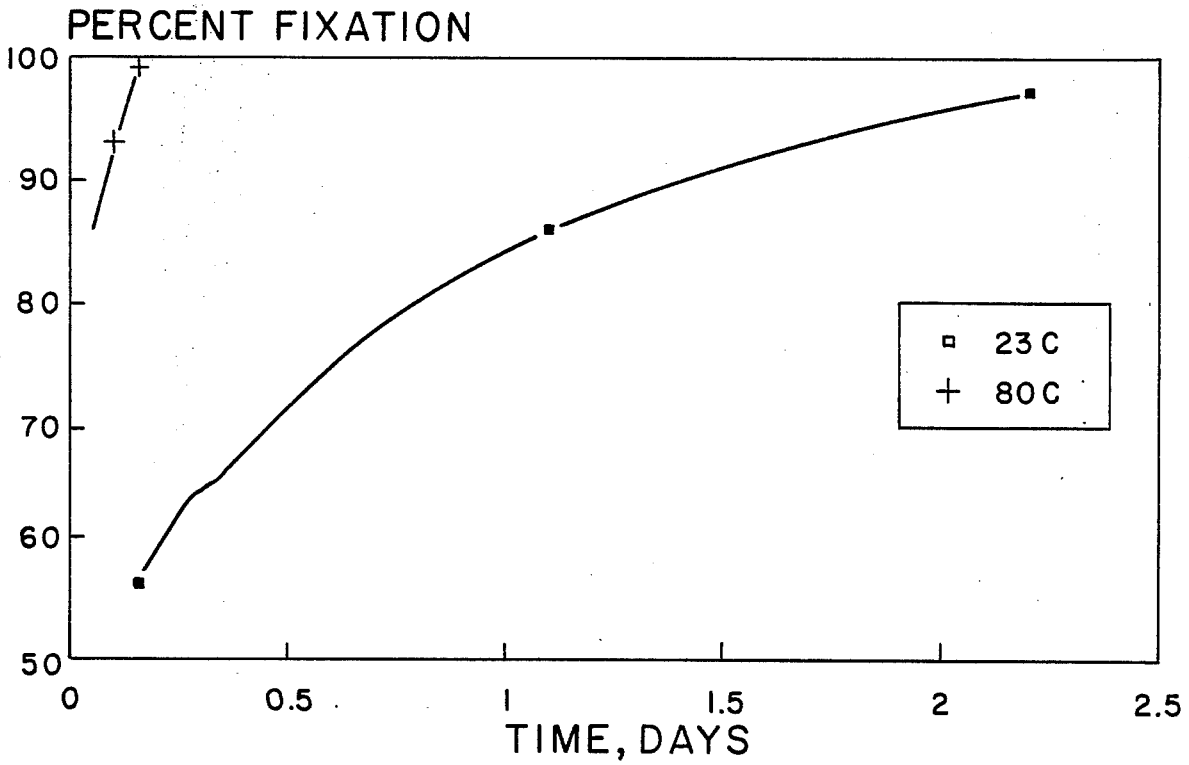
FIG. 2 is a graph of CCA fixation versus temperature for two temperatures in a modified full cell treating process.

This test demonstrates results for thermal fixation in a modified full cell treating cycle. Twelve 1½", southern yellow pine blocks were treated with a 2.00 percent CCA oxide solution. The modified full cell cycle used consisted of two minutes initial vacuum (10 inches of mercury), thirty minutes at 120 p.s.i.g. pressure and thirty minutes at 25 inches of mercury final vacuum. The treating data are given in Table 3. Samples 1–6 were placed in a desiccator, over water to prevent drying, and maintained at 23° C. Samples 7–12 were also placed in a desiccator as above, however, these samples were maintained at 80° C. At various time intervals, samples were removed (two samples at 23° C. and three at 80° C.) and squeezed via a hydraulic press. These extrudates were immediately titrated with standardized iron (II) so as to determine the remaining, unreduced, soluble chromium (VI). The results of these experiments are summarized in Table 4 and illustrated in FIG. 2.

EXAMPLE 1

Two laboratory studies were performed using 0.5 and 1.0% aqueous hydrazine solutions, prepared by diluting 85% hydrazine hydrate, as the second solution for rapid fixation. The experimental technique involved the use of 1.5 inch southern yellow pine blocks and the "squeeze method". The treating cycle used a 2.0% CCA modified full cell to give nominal 0.4 pcf CCA oxides followed by hydrazine solution modified full cell. The treating cycle used is given in Table 5. The treating data for the 0.5 and 1.0% hydrazine treatments are given in Tables 6 and 7, respectively. Blocks from each treatment with CCA-C/hydrazine were "squeezed" via a hydraulic press to obtain solution for chromium (VI) analysis. No chromium (VI) could be detected. Thus, fixation was 99+ percent complete in this laboratory study.

EXAMPLE 2

Figure 3:
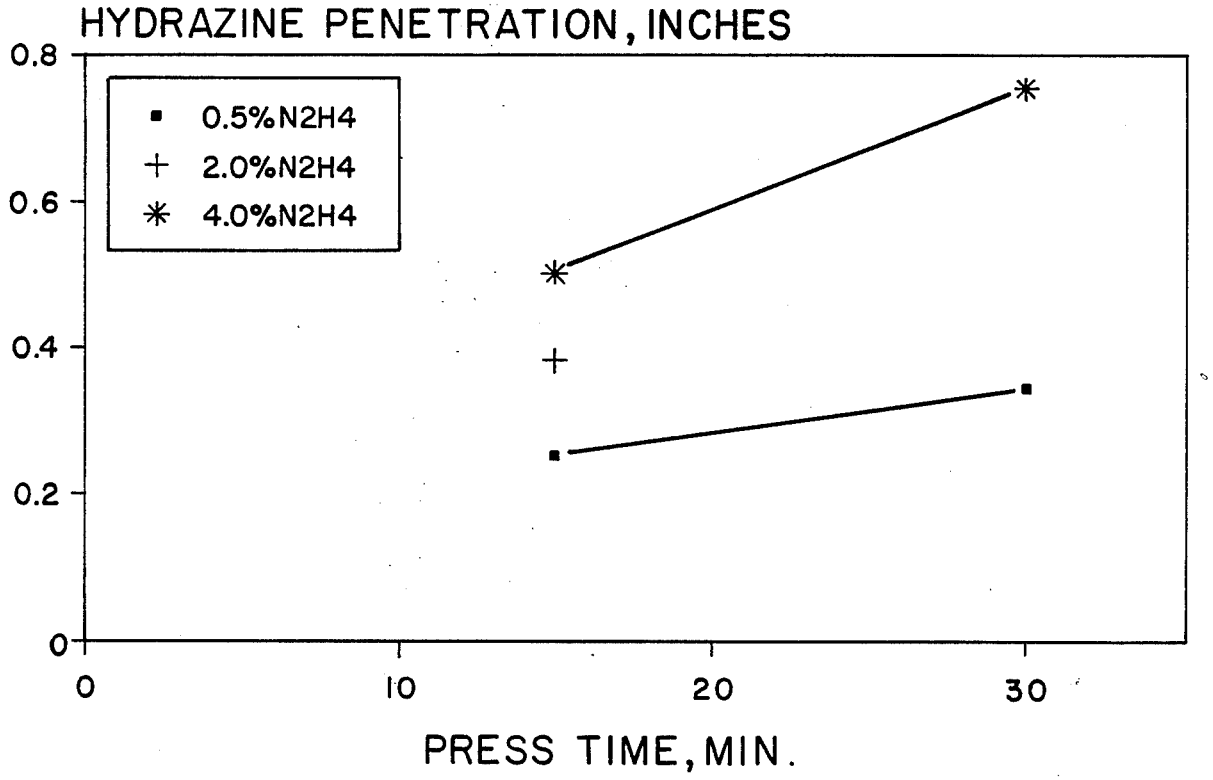
FIG. 3 is a graph of hydrazine penetration versus concentration and time at pressure for various concentrations of hydrazine.

Experiments were performed using end sealed (1.5×3.5×7.0 inch) samples which illustrated the impact of hydrazine concentration and time at a specific pressure (150 p.s.i.g.). These results are summarized in Table 8 and illustrated in FIG. 3.

EXAMPLE 3

A scale-up of the dual, modified full cell CCA-hydrazine treatment was done. A computerized 3'×12' treating cylinder was used for the scale-up activity. The system was placed in manual mode and the CCA and hydrazine solutions were piped directly into the bottom of the cylinder via quick-disconnect hoses. A 1.8% CCA-C solution was prepared from a commercial 50% concentrate. The 1.0% hydrazine was prepared from MOBAY® 85% hydrazine hydrate. The treatment of some nine cubic feet of southern yellow pine lumber stock is given in Table 9. Examination of cross-sections from this treatment of lumber showed hydrazine penetration or CCA fixation of approximately 0.25 inch. Drips from this charge of lumber and two others were collected and analyzed by atomic absorption spectroscopy. These analyses along with a typical analysis of a 1.8% CC-C solution are given in Table 10. The CCA content of these drips are two to three orders of magnitude less than the CCA treating solution and are approaching values that might be obtained by the EP Toxicity Test for CCA-C/southern yellow pine sawdust, i.e. 5–10 ppm for each element. A charge of pole stubs was similarly treated in the pilot plant cylinder. The treating data and cycles are given in Table 11. After treatment and drying, these stubs were cut in half to reveal the depth of hydrazine penetration and CCA fixation. For southern yellow pine, the hydrazine penetration ranged between 0.25 inches to total penetration of the sapwood. For the red pine and lodge pole pine, the hydrazine penetrations ranged between 0.25 to 0.75 inches.

EXAMPLE 4

Figure 4:
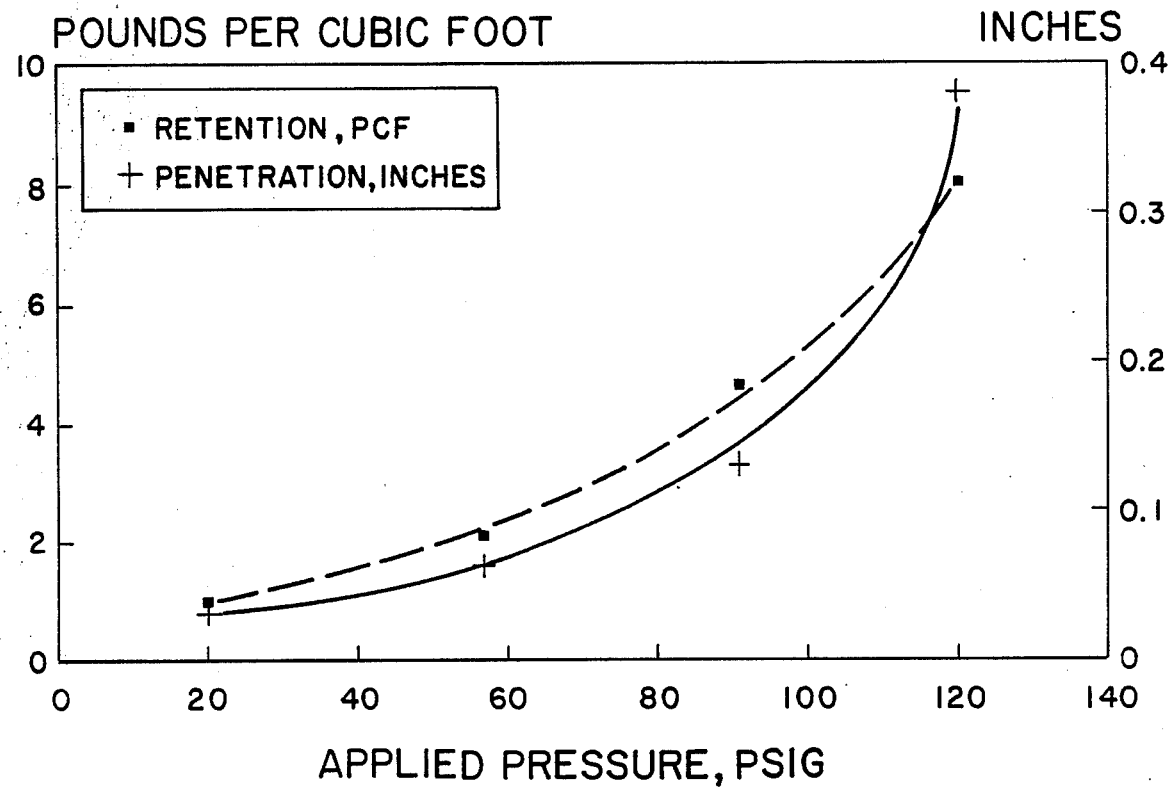
FIG. 4 is a graph of hydrazine retention and penetration versus pressure for one plant trial described herein.

A plant trial was conducted using a 1.8–1.9 percent CCA-C solution prepared by diluting WOLMAN® concentrate, and a 1.0% hydrazine solution, made by diluting MOBAY® 85 percent hydrazine hydrate. The wood was nominal two inches southern yellow pine lumber and is described in Table 12. The treating data for this trial are given in Table 13 for both the CCA and hydrazine cycles. Samples of lumber were obtained from each charge. Cross-sections indicate hydrazine penetration ranged from 1/32 to 3.8 inch depending on the applied pressure. The hydrazine penetration and CCA wood fixation was ⅜, ⅛, 1/16, and 1/32 inch for charges 1 to 4 respectively. These hydrazine solution retentions and depth of penetrations are plotted in FIG. 4.

EXAMPLE 5

This example demonstrates the use of hydroxylamine. A 2.00% CCA-C solution was prepared by diluting 153.6 g of 52.1% WOLMAN® concentrate with 3846 g water. The 2.00% hydroxylamine sulfate was prepared by dissolving 60.0 g hydroxylamine sulfate in 2940 water. A dual modified full cell cycle was used for treating 1.5 inch southern yellow pine blocks. The cycle and treating data are described in Table 14. The blocks were squeezed via a hydraulic press immediately after treatment. No chromium (VI) was detected in the extrudate. Thus fixation of CCA wood was 99+ percent complete.

EXAMPLE 6

This example demonstrates the use of oxalic acid. Twelve 1.5 inch blocks of southern yellow pine were treated in dual modified full cell treating cycles. The cycles used are described in Table 15. The treating data are reported in Table 16. These treated blocks were placed in a desiccator, above water to prevent drying at 23° C. At various time intervals, these blocks were removed and "squeezed". The three extrudates were combined and the chromium (VI) was analyzed as above. The analyses are given in Table 17. Increasing the concentration of oxalic acid in subsequent experiments to 2.0 percent, gave 99+ percent fixation based on chromium (VI) in the extrudate within 0.10 day.

TABLE 1

| | | Full Cell Treatment 2.00% CCA-C Treating Data | | | |
|---|---|---|---|---|---|
| Sample No. | Pre Treat Wt. (g) | Post Treat Wt. (g) | Soln. Gain (g) | % Soln. Gain | Oxides Retention (pcf) |
| 1 | 31.09 | 73.55 | 42.46 | 136.57 | 0.93 |
| 2 | 28.54 | 71.28 | 42.74 | 149.75 | 0.93 |
| 3 | 28.80 | 71.47 | 42.67 | 148.16 | 0.93 |
| 4 | 30.91 | 72.54 | 41.63 | 134.68 | 0.91 |

TABLE 1-continued

| | | Full Cell Treatment 2.00% CCA-C Treating Data | | | |
|---|---|---|---|---|---|
| Sample No. | Pre Treat Wt. (g) | Post Treat Wt. (g) | Soln. Gain (g) | % Soln. Gain | Oxides Retention (pcf) |
| 5 | 31.12 | 72.16 | 41.04 | 131.88 | 0.90 |
| 6 | 33.44 | 74.49 | 41.05 | 122.76 | 0.90 |
| 7 | 29.75 | 74.01 | 44.26 | 148.77 | 0.97 |
| 8 | 29.91 | 72.30 | 42.39 | 141.73 | 0.93 |
| 9 | 32.62 | 74.40 | 41.78 | 128.08 | 0.91 |
| 10 | 40.33 | 73.97 | 33.64 | 83.41 | 0.73 |
| 11 | 39.13 | 74.70 | 35.57 | 90.90 | 0.77 |
| 12 | 35.39 | 72.52 | 37.13 | 104.92 | 0.81 |
| 13 | 28.31 | (Squeezed immediately) | | | |

TABLE 2

CCA Fixation versus Temperature
Determined from chromium(VI) measurement for a full cell treating cycle treated to 0.9 lbs. CCA oxides per cubic foot of southern yellow pine

| Temp. °C. | Time Days | Percent Fixation | Time Days | Percent Fixation | Time Days | Percent Fixation |
|---|---|---|---|---|---|---|
| 4 | 1.1 | 60 | 10.9 | 83 | 30.1 | 91 |
| 23 | 1.1 | 72 | 1.9 | 88 | 10.9 | 99+ |
| 50 | 0.16 | 51 | 0.81 | 96 | 1.9 | 99+ |
| 80 | 0.07 | 72 | 0.14 | 94 | 0.17 | 99+ |

TABLE 3

| | | Modified Full Cell Treatment 2.00% CCA-C Treating Data | | | |
|---|---|---|---|---|---|
| Sample No. | Pre Treat Wt. (g) | Post Treat Wt. (g) | Soln. Gain (g) | % Soln. Gain | Oxides Retention (pcf) |
| 1 | 33.55 | 52.85 | 19.30 | 57.53 | 0.44 |
| 2 | 33.20 | 52.94 | 19.74 | 59.46 | 0.45 |
| 3 | 36.12 | 54.50 | 18.38 | 50.89 | 0.41 |
| 4 | 30.47 | 50.36 | 19.89 | 65.28 | 0.45 |
| 5 | 36.06 | 56.11 | 20.05 | 55.60 | 0.45 |
| 6 | 31.60 | 54.25 | 22.65 | 71.68 | 0.51 |
| 7 | 42.53 | 60.58 | 18.05 | 42.44 | 0.32 |
| 8 | 41.85 | 59.48 | 17.63 | 42.13 | 0.32 |
| 9 | 34.15 | 50.13 | 15.98 | 46.79 | 0.36 |
| 10 | 33.04 | 48.89 | 15.85 | 47.97 | 0.37 |
| 11 | 40.13 | 59.02 | 18.89 | 47.07 | 0.36 |
| 12 | 35.49 | 59.91 | 24.42 | 68.81 | 0.53 |

TABLE 4

CCA Fixation versus Temperature
Determined from chromium(VI) measurement for a modified full cell treating cycle treated to 0.4 lbs. CCA oxides per cubic foot of southern yellow pine

| Temp. °C. | Time Days | Percent Fixation | Time Days | Percent Fixation | Time Days | Percent Fixation |
|---|---|---|---|---|---|---|
| 23 | 0.16 | 56 | 1.1 | 86 | 2.2 | 97 |
| 80 | 0.10 | 93 | — | — | — | — |
| | 0.16 | 99+ | | | | |

TABLE 5

| | Treating Cycle for Dual Modified Full Cell Chemical Fixation | |
|---|---|---|
| | CCA-C First Cycle | Hydrazine Second Cycle |
| Initial Vacuum, inches Hg | 10 | 10 |
| Pressure, psig | 150 | 150 |
| Pressure, minutes | 30 | 30 |
| Final Vacuum, inches Hg | 27 | 27 |
| Final Vacuum, minutes | 30 | 30 |

TABLE 6

Treating Data
Chemical Fixation: Dual Modified Full Cell Treatment
2.00% CCA-C/0.5% Hydrazine

| Pre Treat Wt. (g) | Post Treat Wt. (g) | Soln. Gain (g) | % Soln. Gain |
|---|---|---|---|
| 43.88 | 61.30 | 17.42 | 39.70 |
| 29.04 | 47.27 | 18.23 | 62.78 |
| 41.80 | 59.16 | 17.36 | 41.53 |

TABLE 7

Treating Data
Chemical Fixation: Dual Modified Full Cell Treatment
2.00% CCA-C/1.0% Hydrazine

| Pre Treat Wt. (g) | Post Treat Wt. (g) | Soln. Gain (g) | % Soln. Gain |
|---|---|---|---|
| 38.48 | 55.15 | 16.67 | 43.31 |
| 42.88 | 60.60 | 17.72 | 41.32 |
| 38.94 | 56.77 | 17.83 | 45.79 |
| 34.67 | 49.03 | 14.36 | 41.42 |
| 28.68 | 44.89 | 16.21 | 56.52 |
| 35.75 | 50.49 | 14.74 | 41.23 |

TABLE 8

Hydrazine Penetration vs Hydrazine Concentration and Time at Pressure

| Hydrazine, % | Depth of Penetration, inches 15 min. | 30 min. |
|---|---|---|
| 0.5 | 0.25 | 0.34 |
| 2.0 | 0.38 | — |

TABLE 8-continued

Hydrazine Penetration vs Hydrazine Concentration and Time at Pressure

| Hydrazine, % | Depth of Penetration, inches 15 min. | 30 min. |
|---|---|---|
| 4.0 | 0.50 | 0.75 |

TABLE 10

Analysis of Drips from Hydrazine Fixed CCA-C Treated Lumber

| Element | Drips (ppm) | 1.8% CCA-C |
|---|---|---|
| Cr | 5–17 | 4400 |
| Cu | 5–14 | 2700 |
| As | 20–45 | 4000 |

TABLE 11

CCA - Hydrazine
Pilot Plant Study #4

Treatment #5

| Sample No. | Sample Species | Sample Size | 1st Soln. Pre Treat Wt. (lbs.) | 2nd Soln. Post Treat Wt. (lbs.) | 2nd Soln. Retention pcf |
|---|---|---|---|---|---|
| P-1 | Red Pine | 2.08 × 10.92 | 120.5 | 160.5 | 10.64 |
| P-2 | SYP | 2.54 × 12.08 | 274.5 | 306 | 5.62 |
| P-3 | Lodge Pole | 1.98 × 10.75 | 116.0 | 155 | 11.45 |
| P-4 | SYP | 2.13 × 10.25 | 153.0 | 218 | 16.49 |
| L-1 | SYP | 1.5 × 5.5 × 12.0 | 21.82 | 35.52 | 23.91 |

Treating Cycle

| | |
|---|---|
| **1.8% CCA** | |
| Initial Vacuum/Fill (7" Hg) | 10 min. |
| Pressure (120 psig) | 33 min. |
| Pressure Release | 7 min. |
| Blow Back (15 psig) | 7 min. |
| Final Vacuum (27" Hg) | 39 min. |
| **1.0% Hydrazine** | |
| Initial Vacuum (27" Hg) | 12 min. |
| Fill (27" Hg) | 6 min. |
| Pressure (150 psig) | 30 min. |
| Pressure Release | 5 min. |
| Blow Back (15 psig) | 8 min. |
| Final Vacuum (25" Hg) | 60 min. |

TABLE 12

Plant Trial Chemical Fixation
Charge Descriptions

| Charge | No. Pieces | Charge Description |
|---|---|---|
| 1 | 132 | 2" × 8" × 16' |
| | 1500 | 2" × 8" × 6' |
| 2 | 132 | 2" × 8" × 16' |
| | 432 | 2" × 4" × 12' |
| | 300 | 2" × 10" × 12' |
| 3 | 492 | 2" × 10" × 12' |
| | 132 | 2" × 8" × 16' |
| 4 | 216 | 2" × 8" × 16' |
| | 100 | 2" × 10" × 12' |
| | 600 | 2" × 8" × 8' |

TABLE 13

Treating Data for CCA/Hydrazine Plant Trial

| Charge No. | Solution | Wood Cu. Ft. | Initial Vac. Min. | Initial Vac. "Hg | Fill Vac. Min. | Fill Vac. "Hg | Pressure min. | Pressure psig | Empty min. | Final Vac. min. | Final Vac. "Hg | Work Tank Level Start | Work Tank Level End | Solution Retention Gal. | Solution Retention pcf |
|---|---|---|---|---|---|---|---|---|---|---|---|---|---|---|---|
| 1 | CCA | 838 | 4 | 12 | 6 | 12 | 8 | 150 | 9 | 60 | 27 | 30.64 | 28.62 | 1309.0 | 13.12 |
| | N2H4 | | NA | NA | 19 | 14 | 80 | 55 | NA | 90 | 27 | 21.11 | 19.87 | 803.5 | 8.00 |
| | | | | | | | 10 | 120 | | | | | | | |
| 2 | CCA | 705 | NA | NA | 7 | 14 | 6 | 150 | 10 | 63 | 28 | 30.62 | 29.12 | 972.0 | 11.58 |
| | N2H4 | | 5 | 12 | 27 | 12 | 10 | 91 | 23 | 45 | 28 | 20.41 | 19.81 | 388.8 | 4.60 |
| 3 | CCA | 658 | 6 | 14 | 6 | 14 | 10 | 150 | 11 | 60 | 28 | 30.60 | 28.87 | 1121.0 | 14.31 |
| | N2H4 | | 3 | 12 | 16 | 12 | 5 | 57 | 26 | NA | 28 | 20.00 | 19.75 | 162.0 | 2.05 |

TABLE 13-continued

| Charge No. | Solution | Wood Cu. Ft. | Initial Vac. Min. | Initial Vac. "Hg | Fill Vac. Min. | Fill Vac. "Hg | Pressure min. | Pressure psig | Empty min. | Final Vac. min. | Final Vac. "Hg | Work Tank Level Start | Work Tank Level End | Solution Retention Gal. | Solution Retention pcf |
|---|---|---|---|---|---|---|---|---|---|---|---|---|---|---|---|
| | | | Treating Data for CCA/Hydrazine Plant Trial | | | | | | | | | | | | |
| 4 | CCA | 741 | 3 | 13 | 5 | 13 | 10 | 150 | 12 | 60 | 27 | 30.61 | 28.78 | 1185.8 | 13.44 |
| | N2H4 | | 2 | 12 | 20 | 12 | NA | 20 | 19 | NA | 27 | 19.75 | 19.62 | 84.2 | 0.95 |

TABLE 14

Treating Cycle and Data for Chemical Fixation via Hydroxylamine

| | CCA | Hydroxylamine |
|---|---|---|
| Initial Vacuum, inches Hg | 10 | 27 |
| Initial Vacuum, minutes | 5 | 4 |
| Pressure, psig | 150 | atmospheric |
| Pressure, minutes | 30 | 30 |
| Pressure Release, min. | 7 | — |
| Final Vacuum, inches Hg | 27 | 27 |
| Final Vacuum, minutes | 45 | 30 |

| Sample No. | Pre Treat Wt. (g) | Post Treat Wt. (g) | Soln. Gain (g) |
|---|---|---|---|
| 1 | 46.55 | 66.88 | 20.33 |
| 2 | 48.25 | 68.57 | 20.32 |
| 3 | 46.71 | 66.64 | 19.93 |
| 4 | 49.29 | 69.90 | 20.61 |
| 5 | 53.56 | 78.21 | 24.65 |
| 6 | 49.61 | 70.65 | 21.04 |

TABLE 15

Treating Cycle for Dual Modified Full Cell Chemical Fixation: Oxalic Acid

| | CCA First Cycle | Oxalic Acid Second Cycle |
|---|---|---|
| Initial Vacuum, inches Hg | 10 | 27 |
| Initial Vacuum, minutes | 5 | 30 |
| Pressure, psig | 150 | atmospheric |
| Pressure, minutes | 30 | 60 |
| Final Vacuum, inches Hg | 27 | 27 |
| Final Vacuum, minutes | 30* | 30 |

*The CCA's final vacuum was the oxalic acid's initial vacuum.

TABLE 16

Modified Full Cell (Dual Treatment) 2.00% CCA-C/1.25% Oxalic Acid Treating Data

| Sample No. | Pre Treat Wt. (g) | Post Treat Wt. (g) | Soln. Gain (g) | % Soln. Gain | Oxides Retention (pcf) |
|---|---|---|---|---|---|
| 1 | 58.94 | 88.25 | 29.31 | 49.73 | 0.46 |
| 2 | 56.37 | 81.89 | 25.52 | 45.27 | 0.40 |
| 3 | 56.25 | 81.28 | 25.03 | 44.50 | 0.39 |
| 4 | 56.06 | 69.24 | 13.18 | 23.51 | 0.20 |
| 5 | 35.78 | 58.67 | 22.89 | 63.97 | 0.36 |
| 6 | 54.36 | 78.67 | 23.83 | 43.45 | 0.37 |
| 7 | 50.78 | 74.88 | 24.10 | 47.46 | 0.37 |
| 8 | 58.48 | 85.31 | 26.83 | 45.88 | 0.42 |
| 9 | 60.45 | 88.78 | 28.33 | 46.87 | 0.44 |
| 10 | 55.43 | 80.67 | 25.24 | 45.53 | 0.39 |
| 11 | 55.32 | 79.75 | 24.43 | 44.16 | 0.38 |
| 12 | 59.92 | 90.07 | 30.15 | 50.32 | 0.47 |

TABLE 17

CCA Fixation:Chemical Fixation via Oxalic Acid (1.25%)

| Time Days | Percent Fixation |
|---|---|
| 0.12 | 96 |

TABLE 17-continued

CCA Fixation:Chemical Fixation via Oxalic Acid (1.25%)

| Time Days | Percent Fixation |
|---|---|
| 0.23 | 99+ |

It will be appreciated that there has been described a method for effectively fixing CCA treating agents in wood. Although the invention has been described with a certain degree of particularity, it is to be understood that the present disclosure has been made as an example and that the scope of the invention is defined by what is hereafter claimed.

What is claimed is:

1. A method for fixing chromated copper arsenate agents in wood comprising the steps of impregnating the wood with chromated copper arsenate; and treating the chromated copper arsenate impregnated wood with a fixative agent selected from the group consisting of compounds having the formula $$R_1-\underset{\underset{R_1}{|}}{N}-\underset{\underset{R_1}{|}}{N}-R_1; \quad \text{(a)}$$

$$NH_2O-R_2; \quad \text{(b)}$$

$$R_2-NHOH; \text{ and} \quad \text{(c)}$$

$$R_3-COOH, \quad \text{(d)}$$

and salts thereof, wherein $R_1$ is the same or different and is selected from the group consisting of hydrogen, phenyl or an alkyl group having 1 to about 4 carbon atoms, $R_2$ is selected from the group consisting of hydrogen and an alkyl group having from 1 to about 4 carbon atoms and $R_3$ selected from the group consisting of $(R_4)_2(HO)C-$ and $R_4OOC-$ wherein $R_4$ is selected from the group consisting of hydrogen, an alkyl group having 1 to about 4 carbon atoms, phenyl and pyridyl.

2. The method of claim 1 wherein the wood is treated with hydrazine.

3. The method of claim 1 wherein the wood is treated with alpha-hydroxylamine.

4. The method of claim 1 wherein the wood is treated with beta-hydroxylamine.

5. The method of claim 1 wherein the wood is treated with oxalic acid.

6. The method of claim 1 wherein the wood is treated with glycolic acid.

7. A method for fixing chromated copper arsenate agents in wood comprising the steps of impregnating the wood with chromated copper arsenate; treating the chromated copper arsenate impregnated wood with a fixative agent selected from the group consisting of compounds having the formula $$R_1-\underset{\underset{R_1}{|}}{N}-\underset{\underset{R_1}{|}}{N}-R_1; \quad (a)$$

$$NH_2O-R_2; \quad (b)$$
$$R_2-NHOH; \text{ and} \quad (c)$$
$$R_3-COOH, \quad (d)$$

and salts thereof, wherein $R_1$ is the same or different and is selected from the group consisting of hydrogen, phenyl or an alkyl group having 1 to about 4 carbon atoms, $R_2$ is selected from the group consisting of hydrogen and an alkyl group having from 1 to about 4 carbon atoms and $R_3$ is selected from the group consisting of $(R_4)_2(HO)C-$ and $R_4OOC-$ wherein $R_4$ is selected from the group consisting of hydrogen, an alkyl group having 1 to about 4 carbon atoms, phenyl and pyridyl; and employing picolinic acid as said fixative agent in treating the chromated copper arsenate impregnated wood.

8. The method of claim 1 wherein the wood is treated with 2-hydroxy-2-methylbutyric acid.

9. A method for fixing chromated copper arsenate agents in wood comprising the steps of impregnating the wood with chromated copper arsenate; treating the chromated copper arsenate impregnated wood with a fixative agent selected from the group consisting of compounds having the formula $$R_1-\underset{\underset{R_1}{|}}{N}-\underset{\underset{R_1}{|}}{N}-R_1; \quad (a)$$

$$NH_2O-R_2; \quad (b)$$
$$R_2-NHOH; \text{ and} \quad (c)$$
$$R_3-COOH, \quad (d)$$

and salts thereof, wherein $R_1$ is the same or different and is selected from the group consisting of hydrogen, phenyl or an alkyl group having 1 to about 4 carbon atoms, $R_2$ is selected from the group consisting of hydrogen and an alkyl group having from 1 to about 4 carbon atoms and $R_3$ is selected from the group consisting of $(R_4)_2(HO)C-$ and $R_4OOC-$ wherein $R_4$ is selected from the group consisting of hydrogen, an alkyl group having 1 to about 4 carbon atoms, phenyl and pyridyl; and employing mandelic acid as said fixative agent in treating the chromated copper arsenate impregnated wood.

10. The method of claim 1 wherein the fixative agent is contained in an aqueous solution.

11. The method of claim 10 wherein the fixative agent is in the aqueous solution in a concentration of from about 0.5 to about 4.0 percent by weight.

12. A method for fixing chromated copper arsenate agents in wood comprising the steps of impregnating the wood with chromated copper arsenate; treating the chromated copper arsenate impregnated wood with a fixative agent selected from the group consisting of compounds having the formula $$R_1-\underset{\underset{R_1}{|}}{N}-\underset{\underset{R_1}{|}}{N}-R_1; \quad (a)$$

$$NH_2O-R_2; \quad (b)$$

$$R_2-NHOH; \text{ and} \quad (c)$$

$$R_3-COOH, \quad (d)$$

and salts thereof, wherein $R_1$ is the same or different and is selected from the group consisting of hydrogen, phenyl or an alkyl group having 1 to about 4 carbon atoms, $R_2$ is selected from the group consisting of hydrogen and an alkyl group having from 1 to about 4 carbon atoms and $R_3$ is selected from the group consisting of $(R_4)_2(HO)C-$ and $R_4OOC-$ wherein $R_4$ is selected from the group consisting of hydrogen, an alkyl group having 1 to about 4 carbon atoms, phenyl and pyridyl, and wherein the fixative agent is contained in an aqueous solution; and treating the wood by a modified full cell treating cycle with the aqueous solution containing the fixative agent after the wood has been treated with the chromated copper arsenate agent.

* * * * *